US009797051B2

(12) United States Patent
Federico et al.

(10) Patent No.: US 9,797,051 B2
(45) Date of Patent: Oct. 24, 2017

(54) METHOD OF RETROFITTING OF FINITE-GAP ELECTROLYTIC CELLS

(71) Applicant: THYSSENKRUPP UHDE CHLORINE ENGINEERS (ITALIA) S.r.l., Milan (IT)

(72) Inventors: Fulvio Federico, Piacenza (IT); Dmitri Donst, Cologne (DE); Peter Woltering, Neuenkirchen (DE); Dirk Hoormann, Werne a.d. Lippe (DE); Philipp Hoffmann, Dortmund (DE); Michele Perego, Milan (IT); Alessandro Fiorucci, Origgio (IT); Christoph Hohenberger, Hammersbach (DE)

(73) Assignee: THYSSENKRUPP UHDE CHLORINE ENGINEERS (ITALIA) S.R.L., Milan (IT)

( * ) Notice: Subject to any disclaimer, the term of this patent is extended or adjusted under 35 U.S.C. 154(b) by 92 days.

(21) Appl. No.: 14/783,324

(22) PCT Filed: Apr. 10, 2014

(86) PCT No.: PCT/EP2014/057250
§ 371 (c)(1),
(2) Date: Oct. 8, 2015

(87) PCT Pub. No.: WO2014/167048
PCT Pub. Date: Oct. 16, 2014

(65) Prior Publication Data

US 2016/0032468 A1 Feb. 4, 2016

(30) Foreign Application Priority Data

Apr. 10, 2013 (IT) ..... MI2013A0563

(51) Int. Cl.
*C25B 11/03* (2006.01)
*C25B 9/08* (2006.01)
*C25B 9/18* (2006.01)

(52) U.S. Cl.
CPC ..... *C25B 11/03* (2013.01); *C25B 9/08* (2013.01); *C25B 9/18* (2013.01)

(58) Field of Classification Search
USPC ..... 204/284
See application file for complete search history.

(56) References Cited

U.S. PATENT DOCUMENTS 4,923,583 A * 5/1990 Woodard, Jr. ..... C25B 11/02 204/279
5,454,925 A * 10/1995 Garland ..... C25B 11/03 204/279

(Continued)

FOREIGN PATENT DOCUMENTS

CA 2157827 3/1997
WO 03102271 12/2003

(Continued)

OTHER PUBLICATIONS

International Search Report issued in PCT Application No. PCT/EP2014/057250.

(Continued)

*Primary Examiner* — Harry D Wilkins, III
(74) *Attorney, Agent, or Firm* — Lucas & Mercanti, LLP

(57) ABSTRACT

The present invention concerns a method of retrofitting of a membrane electrolysis cell, wherein a rigid cathode is shaped by plastic deformation of the regions in correspondence of cathodic supports; a pre-shaped conductive elastic element having compressed regions in correspondence of said cathodic supports is overlaid onto said rigid cathode; a flexible planar cathode provided with a catalytic coating is (Continued)

overlaid onto said conductive elastic element. The invention also concerns a correspondingly retrofitted electrolysis cell.

10 Claims, 1 Drawing Sheet

(56) References Cited

U.S. PATENT DOCUMENTS

| | | | | |
|---|---|---|---|---|
| 5,770,035 | A * | 6/1998 | Faita | C25B 1/26 205/640 |
| 6,117,286 | A * | 9/2000 | Shimamune | C25B 9/08 204/252 |
| 6,423,194 | B1 * | 7/2002 | Furuya | C25B 9/066 204/277 |
| 6,841,047 | B2 * | 1/2005 | Gestermann | C25B 1/26 204/252 |
| 8,372,255 | B2 * | 2/2013 | Perego | C25B 9/04 204/279 |
| 2003/0047447 | A1 * | 3/2003 | Shimamune | C25B 1/46 204/252 |
| 2004/0188245 | A1 * | 9/2004 | Katayama | C25B 9/04 204/252 |
| 2004/0216994 | A1 * | 11/2004 | Oldani | C25B 9/203 204/229.4 |
| 2005/0000798 | A1 * | 1/2005 | Faita | C25B 9/08 204/242 |
| 2005/0173257 | A1 | 8/2005 | Bulan et al. | |
| 2005/0183951 | A1 * | 8/2005 | Oldani | C25B 15/08 204/279 |
| 2009/0050472 | A1 * | 2/2009 | Federico | C25B 9/04 204/252 |

FOREIGN PATENT DOCUMENTS

| | | |
|---|---|---|
| WO | 2004040040 | 5/2004 |
| WO | 2008037770 | 4/2008 |
| WO | 2010055152 | 5/2010 |

OTHER PUBLICATIONS

International Preliminary Report on Patentability issued in PCT Application No. PCT/EP2014/057250.

* cited by examiner

METHOD OF RETROFITTING OF FINITE-GAP ELECTROLYTIC CELLS

CROSS-REFERENCE TO RELATED APPLICATIONS

This application is a U.S. national stage of PCT/EP2014/057250 filed on Apr. 10, 2014 which claims the benefit of priority from Italian Patent Application No. MI2013A000563 filed Apr. 10, 2013, the contents of each of which are incorporated herein by reference.

BACKGROUND OF THE INVENTION

The invention relates to a method of retrofitting of membrane electrolysis cells assembled with finite interelectrode gap.

BACKGROUND OF THE INVENTION

Industrial electrolytic processes, for example the electrolysis of alkali brines, in particular of sodium chloride brine aimed at the production of chlorine, caustic soda and hydrogen, are commonly carried out in electrolysers consisting of a multiplicity of electrolytic cells divided by a separator, for example an ion-exchange membrane, into two compartments, anodic and cathodic, each containing an electrode.

The basic design commonly utilised provides that the anode compartment contains a rigid anode generally consisting of a punched plate or expanded sheet or metal mesh coated with a superficial electrocatalytic film comprising noble metal oxides. The structure of the cathode compartment may provide different types of mechanical arrangement. More precisely, the installation of the cathodes in the cathode compartment can be made according to two basic mechanical designs. A first design provides the cathode in direct contact with the membrane (design known among those skilled in the art as "zero-gap"), a second design provides the cathode to be spaced away from the membrane with gaps of 1-3 mm (design known among those skilled in the art as "finite gap"). In this second type of technology, the need to maintain a certain distance between the anodic and cathodic surfaces, approximately 2-3 mm, entails the cell voltage to be penalised by a component associated with the ohmic drop generated by the current transport in the liquid phase between the cathode and the membrane: since the cell voltage is directly proportional to the energy consumption, normally expressed in kWh per tonne of chlorine or caustic soda, it follows that the overall economy of the process is disadvantaged. To overcome this problem, the design of membrane electrolytic cells, especially for chlor-alkali electrolysis, has undergone major changes in time that gave rise to cathodic structures capable of bringing the surface of the cathode in contact with the membrane, a result designated by the aforementioned definition of "zero-gap". In view of the increasingly high cost of energy and the unfavourable economy and feasibility entailed by a complete removal and replacement of "finite-gap" cells, it has been evidenced the need for a technology allowing to convert such cells present in electrolytic plants to the more efficient "zero-gap" technology taking advantage of the existing cell design and materials.

SUMMARY OF THE INVENTION

Various aspects of the invention are set out in the accompanying claims.

Under one aspect, the invention relates to a method of retrofitting of an electrolysis cell comprising a cathodic compartment delimited by a back-wall and an anodic compartment separated by an ion-exchange membrane, the cathode compartment containing a rigid cathode of planar geometry fixed to cathodic supports, the planar rigid cathode being maintained at a gap of 1 to 3 mm from the ion-exchange membrane, the anode compartment contains an anode in contact with the ion-exchange membrane, the method comprising the simultaneous or sequential steps of:

- shaping of said rigid cathode by plastic deformation of the regions comprised between the contact surfaces with said cathodic supports;
- overlaying onto said rigid cathode of a pre-shaped conductive elastic element having compressed regions in correspondence with the contact surfaces of said cathodic supports with said cathode;
- overlaying of a flexible planar cathode provided with a catalytic coating onto said conductive elastic element.

By the above method, it is possible advantageously to convert an electrolytic cell of "finite-gap" technology design into an electrolytic cell of "zero-gap" technology design with no waste of material. Such a conversion, in fact, besides offering the advantage of a more even current distribution during operation, consequently minimising the voltages of the individual cells, on which the energy consumption depends, also allows reusing the cathode as current collector. Unwelding of the cathode with the consequent need of providing each cell with a new cathodic current collector is thereby avoided.

The term "shaping by plastic deformation" is used herein to mean a deformation such that the rigid cathode is permanently curved in order to create a volume capable of receiving the suitably pre-shaped conductive elastic element.

The method of the invention can be applied to electrolytic cells containing rigid planar cathodes for example in form of nickel punched metal sheet or mesh of thickness between 0.4 and 4 mm.

The flexible planar cathode may be in form of a thin, nickel punched sheet or flexible planar mesh of thickness between 0.2 and 0.5 mm provided with an electrocatalytic film.

In one embodiment, when an anode of so-called louver geometry is present in the cells to be retrofitted, the method according to the invention comprises the additional step of overlaying and fixing a planar anodic mesh provided with a catalytic coating onto the louver-shaped anode.

The term "louver geometry" is used herein to mean geometry obtained by making cuts of suitable length in horizontal parallel and staggered rows on a metal sheet and subsequently deforming the sheet in correspondence of the cuts so as to form a plurality of tiles, for instance as described in EP1641962.

The overlaying and fixing, for example by welding, of an anodic mesh of planar geometry to the louvered anode allows the membrane, compressed on the cathode side according to the "zero-gap" design, to establish an adequate contact with the anode without being damaged.

In one embodiment, the method according to the invention provides that the rigid planar cathode is shaped by plastic deformation of the regions comprised between the contact surfaces with the cathodic supports in the range of 1 to 5 mm.

In one embodiment the pre-shaped conductive elastic element has compressed regions in correspondence with the contact surfaces of the rigid cathode with the cathodic supports of thickness below 1 mm.

The cathodic supports may be in form of parallel ribs fixing the distance between the rigid cathode and the cathodic back-wall.

The cathodic supports and the anodic supports may be made respectively of nickel and titanium.

The conductive elastic element can be obtained for example by superposition of two or more conductive corrugated metal webs or from a mattress formed by interpenetrated coils obtained starting from one or more metal wires made of nickel typically having a total thickness of 2.5 to 5 mm.

The catalytic film applied on the cathodes and anodes are catalytic films of compositions known in the art for evolution of hydrogen at the cathode side and of chlorine at the anode side, when the retrofitted cell is a cell for chlor-alkali electrolysis.

Under a further aspect, the invention is related to an electrolysis cell comprising a cathodic compartment delimited by a cathodic back-wall and an anodic compartment separated by an ion-exchange membrane, the cathode compartment containing cathodic supports, a rigid current distributor having regions comprised between the contact surfaces with said cathodic supports plastically deformed along the vertical axis by 1 to 5 mm, a conductive elastic element having regions of thickness in the range of 0.1 to 1 mm in correspondence with the contact surfaces of the rigid current distributor with the cathodic supports, a flexible cathode consisting of a punched sheet or mesh of thickness ranging from 0.2 to 0.5 mm in uniform contact with the conductive elastic element on one side and with the ion-exchange membrane on the other side, the anodic compartment containing an anode in uniform contact with the ion-exchange membrane. In one embodiment of the electrolysis cell, the anode is made of a louver-shaped base with a planar punched sheet or mesh of thickness ranging from 0.3 to 1 mm and provided with an electrocatalytic film fixed thereon.

Under a further aspect, the invention relates to an electrolyser consists of a modular arrangement of a multiplicity of elementary cells obtained by the above described method according to the invention.

Some implementations exemplifying the method of retrofitting according to the invention will now be described with reference to the attached drawings, which have the sole purpose of illustrating the reciprocal arrangement of the different elements relatively to said particular implementations of the invention; in particular, drawings are not necessarily drawn to scale.

DETAILED DESCRIPTION OF THE DRAWINGS

Figure 1:
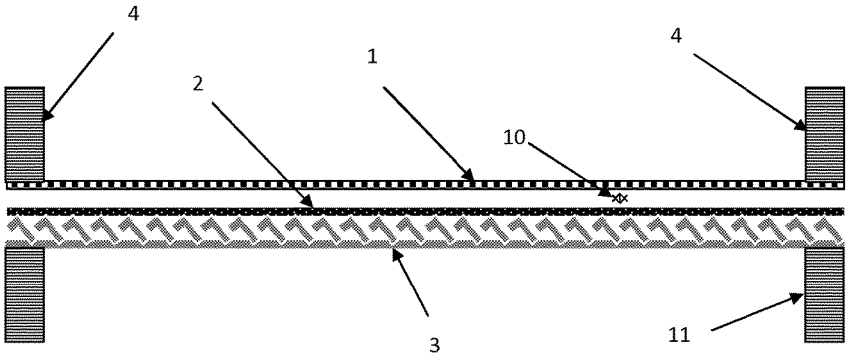
In FIG. 1 there is shown the assembly of a section of the cell comprised between two cathodic supports according to a mechanical design in accordance with the technology known as "finite-gap".

FIG. 1 shows a front view of a section of the cell comprised between two cathodic supports 4 and two anodic supports 11 according to a mechanical design in accordance with the technology known as "finite-gap", a rigid current distributor of planar geometry acting as cathode 1 facing an ion-exchange membrane 2 at a finite gap 10. Membrane 2 is in its turn overlaid and in contact with an anode having a louvered geometry 3.

Figure 2:
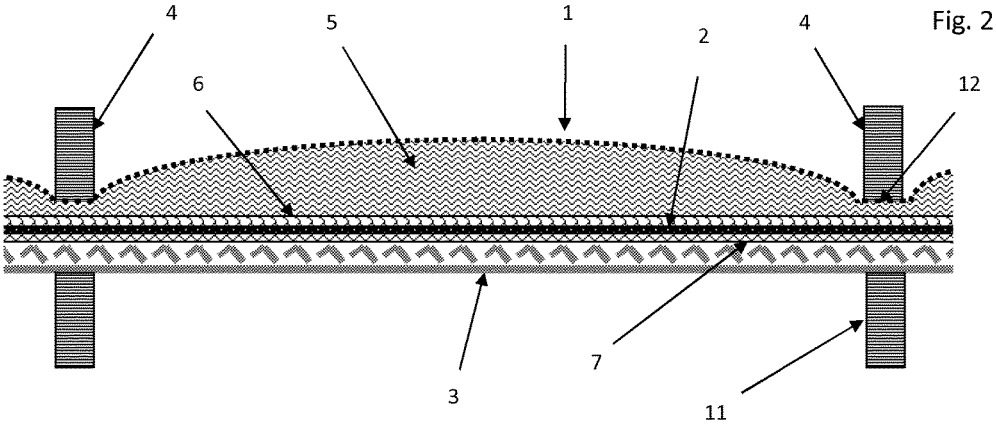
In FIG. 2 there is shown an assembly of a section of the cell comprised between two cathodic supports after a retrofitting according to the method of the invention.
Figure 3:
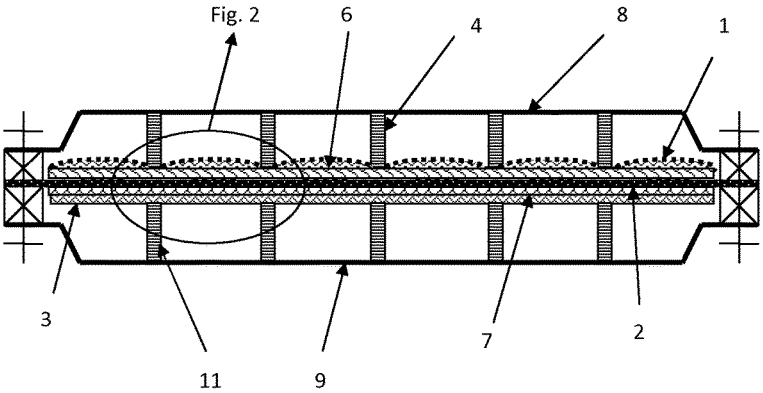
In FIG. 3 there is shown the assembly of a whole cell after a retrofitting according to the invention.

FIG. 2 shows a view of a detail of FIG. 3. More precisely, there is shown a front view of a section of the cell comprised between two cathodic supports 4 and two anodic supports 11 according to the invention. A current distributor 1 is obtained by curving of the cathode 1 of FIG. 1 in the regions 12 in correspondence of said cathodic supports 4. A pre-shaped conductive elastic element 5 is in contact with current distributor 1 on one side and flexible cathode 6 on the other, the latter being in intimate contact with ion-exchange membrane 2. Below ion-exchange membrane 2 there is depicted the anode comprised of a catalytically-coated planar mesh 7 welded on a portion of metal sheet of louvered geometry 3.

FIG. 3 shows a front view of an electrolytic cell according to the invention wherein the two cathodic and anodic shells, respectively indicated with 8 and 9, cathodic current distributor 1, cathodic and anodic supports, respectively indicated with 4 and 11, the anode comprised of louver sheet 3 welded to planar catalysed anode mesh 7 and flexible cathode 6 are shown.

EXAMPLE 1

An electrolytic cell was assembled according to the method of the invention with a result according to the scheme of FIG. 3. Starting from the components of a cell assembled in accordance to a "finite-gap" design, the following operations were carried out. The rigid cathode in form of 1 mm-thick sheet was bent in the regions between the contact surfaces with the cathodic supports in an area of about 2.5 mm. A conductive elastic element formed of interpenetrated coils of double nickel wires having a diameter of about 0.2 mm was also shaped by rolling so as to obtain compressed areas in correspondence of the areas of the rigid cathode in contact with the cathodic supports. A 0.3 mm-thick flexible cathodic mesh provided with a catalytic layer was then overlaid in intimate contact with the conductive elastic element. In the anodic compartment of the cell a 0.5 mm-thick planar titanium mesh coated with a catalytic layer of mixed oxides of platinum group metals was welded onto the pre-existing louver anode. The above elements were then assembled, obtaining a cell structure according to FIG. 3.

EXAMPLE 2

The efficacy of cancelling the cathode-membrane gap by the retrofitting of a cathode of a cell originally having an internal geometry of "finite-gap" type and the installation of a new cathode coupled to a compressing elastic element as described in Example 1 was tested on a pilot electrolyser used for chlor-alkali membrane electrolysis. The electrolyser was equipped with eight single cells. The electrolyser was operated with 32% by weight caustic soda, sodium chloride brine at an outlet concentration of 210 g/l, at 90° C. and at a current density of 5 $kA/m^2$. After a stabilisation period of about 1 week, the cells were characterised by an average voltage of 2.90 V, which remained essentially unchanged after 6 months of operation, when the electrolysis was discontinued and two single cells were extracted from the supports, opened and subjected to visual inspection of the components. The inspection did not emphasise any alteration worthy of note, and in particular the two membranes presented a surface essentially free of notches or other types of traces generated by abnormal compression of the cathode. As a term of comparison, the above described electrolyser showed energy savings of about 150 kWh per tonne of product caustic soda with respect to to an electrolyser equipped with the original cells prior to retrofitting, characterised by a membrane-cathode gap of 1.5 mm.

The previous description shall not be intended as limiting the invention, which may be used according to different embodiments without departing from the scopes thereof, and whose extent is solely defined by the appended claims.

Throughout the description and claims of the present application, the term "comprise" and variations thereof such as "comprising" and "comprises" are not intended to exclude the presence of other elements, components or additional process steps.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention before the priority date of each claim of this application.

The invention claimed is:

1. Method of retrofitting of an electrolysis cell comprising a cathodic compartment delimited by a cathodic back-wall and anodic compartment, separated by an ion-exchange membrane, said cathodic compartment containing a rigid planar cathode fixed to cathodic supports, said rigid planar cathode being spaced apart by 0.4 to 4 mm from said ion-exchange membrane, said anodic compartment containing an anode in contact with said ion-exchange membrane, the method comprising the simultaneous or sequential steps of:

shaping said rigid cathode by plastic deformation of the regions in correspondence of said cathodic supports;

overlaying onto said rigid cathode of a pre-shaped conductive elastic element having compressed regions in correspondence of said cathodic supports;

overlaying a flexible planar cathode provided with a catalytic coating onto said conductive elastic element.

2. Method according to claim 1, wherein said anode in contact with said ion-exchange membrane is a louver-shaped anode, the method comprising the additional step of overlaying and fixing a planar anodic mesh provided with a catalytic coating onto said louver-shaped anode.

3. Method according to claim 2, wherein said planar anodic mesh is made of titanium and provided with an electrocatalytic film for chlorine evolution.

4. Method according to claim 1 wherein said planar rigid cathode is shaped by plastic deformation of the regions in correspondence of said cathodic supports in the range of 1 to 5 mm.

5. Method according to claim 1 wherein said pre-shaped conductive elastic element has compressed regions in correspondence of said cathodic supports having a thickness below 1 mm.

6. Method according to claim 1 wherein said planar rigid cathode consists of a punched sheet or expanded sheet or mesh made of nickel, provided with an electrocatalytic film for hydrogen evolution.

7. Method according to claim 1 wherein said cathodic supports consist of parallel ribs setting the distance between the rigid cathode and the cathodic back-wall.

8. Electrolysis cell comprising a cathodic compartment delimited by a cathodic back-wall and an anodic compartment separated by an ion-exchange membrane, said cathodic compartment containing a rigid planar cathode fixed to cathodic supports, said anodic compartment containing an anode in uniform contact with said ion-exchange membrane, wherein said electrolysis is retrofitted with said rigid planar cathode being curved into a rigid current distributor having regions comprised between said cathodic supports plastically deformed along the vertical axis by 1 to 5 mm, with a conductive elastic element having regions of thickness in the range of 0.1 to 1 mm in correspondence of said cathodic supports and with a flexible cathode consisting of a punched sheet or mesh of thickness ranging from 0.2 to 0.5 mm in uniform contact with said conductive elastic element on one side and with said ion-exchange membrane on the other side.

9. Electrolysis cell according to claim 8, wherein said anode is made of a louver-shaped base with a planar punched sheet or mesh of thickness ranging from 0.3 to 1 mm and provided with an electrocatalytic film fixed thereon.

10. Electrolyser consisting of a modular arrangement of a multiplicity of elementary cells according to claim 8.

* * * * *